US006387195B1

(12) United States Patent
Bishop et al.

(10) Patent No.: US 6,387,195 B1
(45) Date of Patent: May 14, 2002

(54) RAPID QUENCH OF LARGE SELECTION PRECIPITATION HARDENABLE ALLOYS

(75) Inventors: William J. Bishop, Amherst; Noel M. Brady, University Heights; Walter R. Cribb, Solon; Anatoly A. Offengenden, Amherst, all of OH (US)

(73) Assignee: Brush Wellman, Inc., Cleveland, OH (US)

( * ) Notice: Subject to any disclaimer, the term of this patent is extended or adjusted under 35 U.S.C. 154(b) by 0 days.

(21) Appl. No.: 09/706,465

(22) Filed: Nov. 3, 2000

(51) Int. Cl.[7] ..... C22F 1/08

(52) U.S. Cl. ..... 148/660; 148/664; 148/675; 148/686

(58) Field of Search ..... 148/660, 664, 148/675, 686

(56) References Cited

U.S. PATENT DOCUMENTS 3,658,601 A * 4/1972 Britton et al. ..... 148/685
4,434,016 A * 2/1984 Saleh et al. ..... 148/682
6,001,196 A 12/1999 Harkness et al.
6,231,700 B1 * 5/2001 Stone et al. ..... 148/686

OTHER PUBLICATIONS

John C. Harkness et al., "Beryllium–Copper and Other Beryllium–Containing Alloys," *Metals Handbook*, vol. 2, 10 Ed, ©1993 ASM International, pp. 403–427.

William Nielsen, Jr. et al., "Unwrought Continuous Cast Copper–Nickel–Tin Spinodal Alloy," U.S. Patent Appln. No. 08/552,582, filed Nov. 3, 1995.

* cited by examiner

*Primary Examiner*—George Wyszomierski
(74) *Attorney, Agent, or Firm*—Calfee, Halter & Griswold, LLP

(57) ABSTRACT

Large sections of solution annealed, precipitation hardenable alloys which are resistant to internal cracking yet fully hardenable can be produced if, during rapid quenching, the temperature of the section is allowed to stabilize immediately above the alloy's solvus temperature before the section is rapidly quenched. Preferably, the temperature of the section is allowed to stabilize a second time, this time at an elevated temperature not so high that significant phase changes occur, before the section is cooled to ambient.

13 Claims, 3 Drawing Sheets

RAPID QUENCH OF LARGE SELECTION PRECIPITATION HARDENABLE ALLOYS

BACKGROUND

1. Field of the Invention

The present invention relates to a new method for rapidly quenching large sections of precipitation hardenable alloys.

2. Background

A precipitation hardenable (or "age hardenable") alloy is an alloy which, when heated at a temperature below its solvus temperature, nucleates and grows a precipitate of alloy components. Precipitation hardening normally causes a noticeable increase in alloy hardness as well as beneficial enhancement of other alloy property combinations including, for example, strength, ductility and electrical conductivity.

Industrially, precipitation hardening is accomplished by heating the alloy at a fairly narrow temperature range roughly midway between the solvus temperature and room temperature for 0.5 to 20 hours. Precipitation hardening temperatures approaching the solvus temperature are usually avoided, since it is difficult to control the results obtained at these higher temperatures and the nature of the precipitates changes significantly. Precipitation hardening at less than a minimum practical hardening temperature at which precipitation hardening is too slow to be commercially feasible is also avoided.

Precipitation hardening will not normally occur unless the ingredients of the alloy are distributed fairly uniformly in the alloy mass. Therefore, precipitation hardenable alloys are normally subjected to one or more heat treatment and/or wrought processing steps, prior to precipitation hardening, to reduce the gross and/or micro-segregation of elements which inherently occurs when molten alloys solidify and to refine microstructure. Examples of such processing steps include homogenization, solution annealing, hot working and cold working.

In homogenization, the alloy is heated at a temperature below but relatively near the alloy's solidus temperature for an extended period of time such as 4 to 12 hours, for example, and then quenched. Homogenization is normally done early in the processing regimen, normally as the first processing step after the alloy is cast. As a result of homogenization, the alloy solute elements tend to dissolve in the alloy matrix, thereby achieving a more nearly uniform distribution of ingredients. Quenching after homogenization can be rapid or slow and is most typically done by air-cooling.

Solution annealing is similar to homogenization in that the ingot is also heated near but below its solidus temperature. However, solution annealing normally presupposes that the alloy already starts with a fairly uniform element distribution, with heating being done merely to dissolve elements that may have undergone short-range segregation during cooling from a prior hot working or heat-treatment step. Furthermore, heating times are usually significantly shorter than in conventional homogenization, on the order of a few minutes to several hours or so. Section size, that is the size of the metal mass or section being heated, also plays a role in heating times because of thermal conductivity limitations.

Solution annealing also connotes that the alloy is rapidly quenched to a temperature at or near ambient normally to its lowest hardness condition. By "rapid quenching" is meant that the temperature of the alloy throughout its mass is reduced as rapidly as possible on a commercially feasible basis. Usually, rapid quenching is done by immersion in water, although other techniques can be used such as contact with oil, cooling gas or other material. Rapid quenching "freezes" the dissolved ingredients in place, thereby preventing formation of other phases which can occur if cooling is slower.

In hot and cold working, the alloy is subjected to significant, uniform mechanical deformation to mechanically break up larger crystal grains into smaller sizes. Hot working is normally done between the alloy's solvus and solidus temperatures, thereby allowing recrystallization of the alloy components into smaller grains upon cooling. Cold working is normally done at ambient temperature and, in any event, below precipitation hardening temperatures. Cold working can be followed by solution annealing, which also promotes recrystallization of the alloy ingredients into smaller grains.

Solution annealed, precipitation hardenable alloys in the form of large sections are difficult to produce reliably and consistently. In this context, "section" means a mass of the alloy whether or not previously worked to change its size or shape. In some instances, the alloy is not fully hardenable as reflected by insufficient strength and/or hardness when the alloy is precipitation hardened. In other instances, the alloy mass suffers internal cracking during heat treatment or distortion during subsequent machining and/or use. Depending upon the particular alloy involved, these problem are observed in sections whose minimum caliper (minimum thickness dimension) is as little as 3 inches. In other alloys, these problems are not observed until the minimum caliper of the section is 8 inches or more. Thus, a "large" section of a precipitation hardenable alloy in the context of this case means a section whose minimum caliper is large enough so that, after conventional solution annealing using a water immersion quench, one or more of the above problems is observed.

SUMMARY OF THE INVENTION

In accordance with the present invention, it has been discovered that large sections of solution annealed, precipitation hardenable alloys which are resistant to internal cracking and distortion yet fully hardenable can be produced if, during quenching of the alloy, the temperature of the section is allowed to stabilize immediately above the solvus temperature before the section is rapidly quenched. Preferably, the temperature of the section is allowed to stabilize a second time, at the end of rapid quenching, before the section is cooled to ambient.

Thus, the present invention provides a new process for quenching a precipitation hardenable alloy in which the alloy is cooled from a solution anneal temperature down to a final quench temperature, the process comprising allowing the temperature of the alloy to stabilize at a first stabilization temperature immediately above the solvus temperature of the alloy before the alloy is rapidly quenched. Preferably, the temperature of the alloy is also allowed to stabilize a second time at a second stabilization temperature higher than the final quench temperature yet not so high that any significant phase or hardness change occurs in the alloy, before cooling to the final quench temperature.

In addition, the present invention further provides as new products, large sections of precipitation hardenable alloys which are fully hardenable and yet have a reduced tendency for internal cracking and distortion, the alloy sections being made by a heat treatment process in which the temperature of the section is allowed to stabilize immediately above the alloy's solvus temperature before rapid quenching.

BRIEF DESCRIPTION OF THE DRAWINGS

The present invention may be more readily understood by reference to the following drawings wherein.

DETAILED DESCRIPTION

Figure 1:
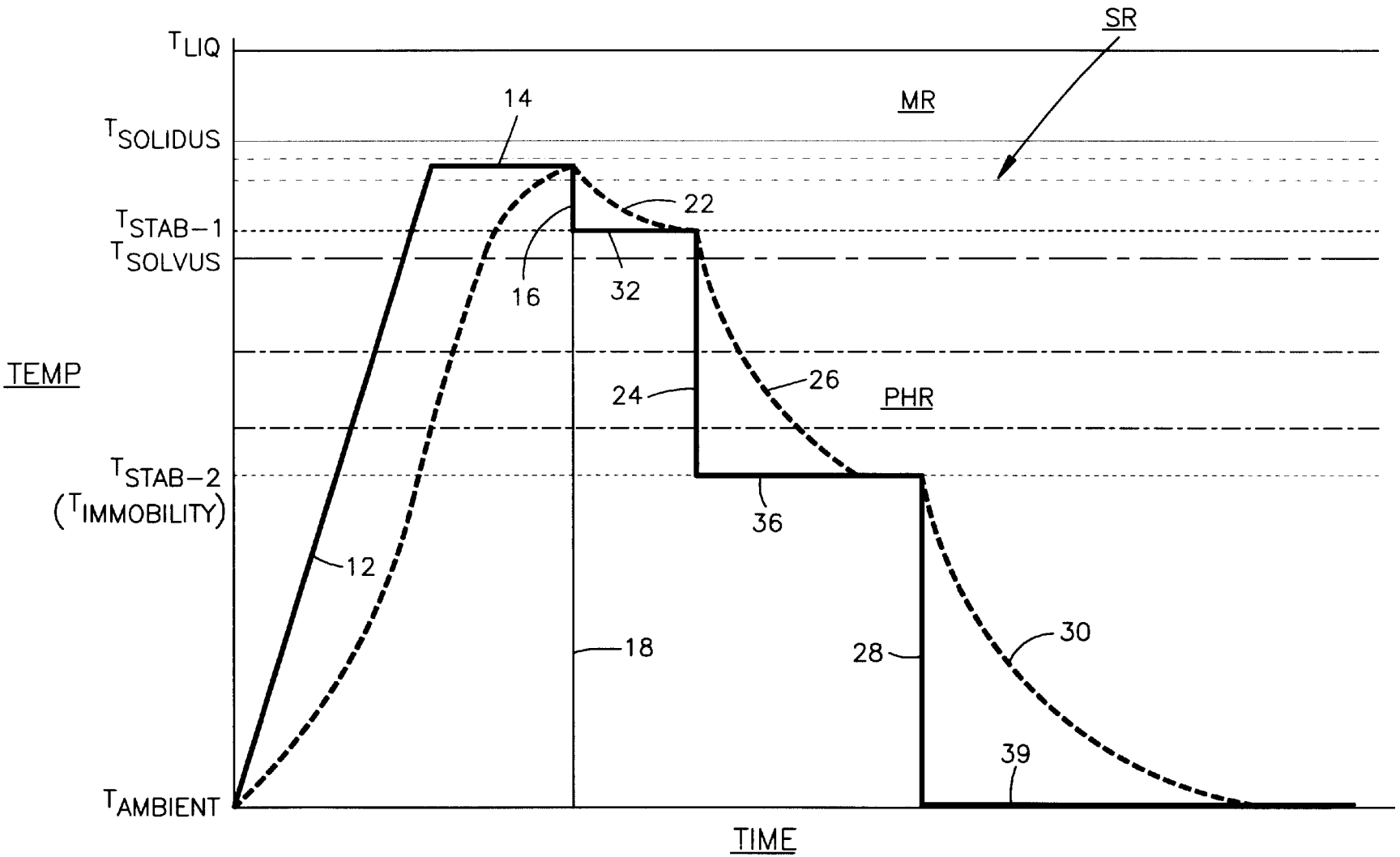
FIG. 1 is a schematic representation illustrating the surface and interior temperatures of a large section, precipitation hardenable alloy being rapidly quenched in accordance with one quenching scheme of the present invention.

The present invention relates to a new process for rapidly quenching large sections of precipitation hardenable alloys and the alloy sections so made.

Rapid Quench

As indicated above, rapid quenching of precipitation hardenable alloys is normally done after solution anneal to freeze the solute elements in place. Rapid quenching may also be done after homogenization, typically where no solution anneal is involved. Rapid quenching may also be done after precipitation hardening as well.

In all cases, rapid quenching is carried out in accordance with the present invention in a modified manner in which the temperature of the alloy is allowed to stabilize or equilibrate immediately above its solvus temperature before the alloy is rapidly quenched to its final quench temperature. In a preferred embodiment, the temperature of the alloy is allowed to stabilize a second time, this time at a second stabilization temperature which is above the final quench temperature but at or below an immobility temperature where no phase change occurs as a practical matter. In accordance with the present invention, it has been found that this approach minimizes formation of internal cracks and distortions in the solution annealed (or homogenized) product, thereby allowing larger crack and distortion-free sections of precipitation hardenable alloys to be made than possible using conventional quenching technology.

Although not wishing to be bound to any theory, it is believed that internal cracking and distortion are reduced in accordance with the present invention because the temperature drop to which the alloy section is put during rapid quenching is smaller than in conventional practice. In particular, it is believed that internal cracking of large alloy sections is driven by the temperature differential between the interior and surface of the section during rapid quench. Because of the moderate thermal conductivity of most precipitation hardenable alloys, the interior of the section stays hotter than its surface during rapid quench. As a result, the surface portion of the section shrinks faster than its interior. This, in turn, sets up internal stresses in the section, with the surface portion of the section being under tension and the interior being under compression. The net effect is that the section is prone to cracking and/or distortion as a means of relieving these stresses.

In accordance with the present invention, these internal stresses are reduced because the temperature of the alloy is allowed to stabilize at or near its solvus temperature before rapid quench. Therefore, the temperature drop to which the section is put during rapid quench is less than would otherwise be the case. For example, beginning rapid quench of Alloy C72700 (Cu—9Ni—6Sn) at slightly above its solvus temperature (1364° F./740° C.) rather than at or above 1500° F. (815° C.) in accordance with normal practice eliminates about 140° F. (78° C.) of the temperature differential encountered by the section during conventional rapid quench and hence about 7 to 8% of the internal stress set up by the quenching operation. The net effect is the tendency of the section to crack or otherwise distort is reduced.

In the preferred embodiment of the invention, the temperature of the alloy section is allowed to stabilize or equilibrate a second time, this time at a second stabilization temperature which is higher than the final quench temperature but at or below an "immobility temperature" at which no phase or hardness change occurs as a practical matter yet. Usually, the second stabilization temperature will be within about 200° F., more typically about 150° F., and even about 100° F., below the temperature at which precipitation hardening of the alloy occurs in commercial practice. Diffusion rates of alloy components decrease markedly with decreasing temperature. Indeed, a metallurgical rule of thumb is that diffusion rates decrease by about ½ for every 10° C. decrease in temperature. Therefore, the effective time needed to achieve any reaction doubles for every 10° C. decrease in temperature. This means that essentially no adverse phase change will occur during the second stabilization step, even if carried out at temperatures as little as 100° F. below the commercial precipitation hardening temperature, since the time it takes for this stabilization is still comparatively short. Of course, the second stabilization step can be carried out at lower temperatures such as, for example, 350° F., 300° F. or even 250° F., although no particular advantage will be obtained by following this approach.

As a result of stabilizing the alloy's temperature at the second stabilization temperature, a further decrease in the temperature drop to which the alloy section is subjected during rapid quench is achieved. For example, ending rapid quench of Alloy C72700 at an immobility temperature of 675° F. (357° C.) rather than a final quench temperature of about 100° F. (38° C.) in accordance with normal practice eliminates about 575° F. (320° C.) of the temperature differential encountered by the alloy section during conventional rapid quench. This, in turn, eliminates an additional 30% of the potential internal stress due to quenching. The net effect is a total reduction of almost 40% in the potential internal stress due to quenching, which in turn leads to a significant decrease in the tendency of the alloy section to crack and/or distort during manufacture and use.

As for achieving a fully hardenable alloy, rapid quenching is still carried out in accordance with the present invention over most if not all of the temperature range where unwanted phases can form (the "temperature-sensitive zone"). Therefore, the full advantage of rapid quench—freezing the alloy components in place without allowing unwanted phases to form—still occurs completely or at least substantially completely.

Thus, the present invention is based on the realization that internal cracking and distortion which occur when large sections of precipitation hardenable alloys are solution annealed derives from the thermal stress placed on the section during conventional rapid quenching. In addition, the present invention is also based on the further recognition that this thermal stress can be regarded as being derived from three components—a first component attributable to cooling from the solution anneal temperature to the solvus temperature, a second component attributable to cooling from the solvus temperature to an immobility temperature where no phase change occurs as a practical matter, and a third component attributable to cooling from the immobility temperature to the final quench temperature. To prevent formation of unwanted alloy phases, the alloy must be rapidly quenched through the second cooling increment (solvus temperature to immobility temperature), since this is the temperature sensitive zone where unwanted phase changes can occur. Outside this range, however, unwanted phase changes do not occur as a practical matter. Therefore, rapid quench is preferably restricted in accordance with the present invention to just this temperature sensitive range, with provisions being taken to allow the temperature of the ingot to stabilize immediately above, and preferably immediately below, this temperature range. As a result, the first and third components of thermal stress associated with conventional practice have been effectively eliminated by the present invention. The result is that larger sections of fully precipitation hardenable alloys can be produced without the internal cracking and distortion characteristic of prior technology.

The present invention may be more readily understood by reference to the FIG. 1 which is a schematic representation of the surface and internal temperatures of a large section, precipitation hardenable alloy being rapidly quenched in accordance with the present invention as a function of time. Solid lines in this figure represent surface temperature, while dashed lines represent internal temperature.

As shown in this figure, the alloy being processed like all other precipitation hardenable alloys has a unique liquidus temperature, $T_{LIQ}$, above which the alloy is entirely molten and a unique solidus temperature, $T_{SOLIDUS}$, below which the alloy is completely solid. Together, these temperatures define a melting range, MR in FIG. 1, in which liquid and solid exist together. The alloy also has a solvus temperature, $T_{SOLVUS}$, above which the ingredients in the alloys tend to dissolve uniformly in one another but below which the ingredients tend to separate out into different phases. The alloy also defines a fairly narrow temperature range where the alloy can be precipitation hardened under commercially reasonable conditions, this temperature range being denoted as PHR in FIG. 1. In addition, the alloy also defines an immobility temperature, $T_{IMMOBILITY}$, which is high enough so that unwanted phase changes will occur if the alloy is held at this temperature for an extended period of time such as 10 hours, for example, but not so high that unwanted phase changes occurs to any significant degree over the time it takes for temperature stabilization in accordance with the present invention, typically ½ to 1 hour or so.

In conventional solution annealing technology, the alloy is heated from ambient temperature to a solution annealing temperature which is normally slightly below the solidus temperature of the alloy. The alloy is then held at this temperature for a suitable period of time, such as ½ to 1 hour or so, thereby allowing any elements that may have segregated during earlier processing steps to re-dissolve. Then, the alloy is rapidly quenched to ambient temperature, such as by immersion in water or the like. This is illustrated in FIG. 1 which shows the alloy being heated along line segment 12 to a solution annealing temperature range SR where it is held for a suitable period of time (line 14) and then rapidly quenched to ambient along lines 16/18.

In accordance with the present invention, however, the alloy is cooled during quenching in a modified manner in which the temperature of the alloy is allowed to stabilize at a first stabilization temperature slightly above the alloy's solvus temperature, and preferably then again at a second stabilization temperature which is above the final quench temperature but at or below the immobility temperature where no significant phase changes occur as a practical matter.

In the particular embodiment illustrated in FIG. 1, the alloy section is withdrawn from the annealing furnace and immediately put into a holding furnace maintained at the first stabilization temperature, $T_{STAB\text{-}1}$, slightly above the solvus temperature of the alloy, $T_{SOLVUS}$. As a result, the surface temperature of the section drops along line segment 16 to the first stabilization temperature essentially immediately. The interior of the section, however, cools more slowly along line segment 22 until it too reaches the first stabilization temperature.

Then the section is immersed in a molten salt bath maintained at the immobility temperature of the alloy, $T_{IMMOBILITY}$, which as shown in FIG. 1 is somewhat below the minimum practical precipitation hardening temperature—i.e., the lower limit of PHR. As a result, the surface of the section immediately cools along line segment 24 to the second stabilization temperature, which in this instance is the same as the immobility temperature. Meanwhile, the interior of the section cools more slowly along line segment 26 until it too reaches the second stabilization temperature. At that time, the section is immersed in another cooling medium such as water where it is allowed to reside until quenching is complete. As shown in FIG. 1, during this period the surface of the section cools to ambient along line segment 28, while the interior cools to ambient along line segment 30.

In accordance with the present invention, it has been found that internal cracking and plastic deformation of large alloy sections during manufacture as well as distortion of such large sections during use can be significantly reduced or eliminated by proceeding in this manner. The internal stress placed on an section being cooled is believed proportional to the difference between the section's internal and external temperatures. This difference is represented in FIG. 1 by the vertical distance between the section's internal and external temperature. For example, this difference is represented by the vertical distance between line segment 22 and line segment 32 during the first cooling step of the invention, by the vertical distance between line segment 26 and 36 during the second cooling step of the invention and the vertical distance between line segment 30 and 39 in the third cooling step of the invention. In conventional quenching, however, this difference is represented by the vertical difference between line segment 22 and ambient temperature, a much greater distance. It will therefore be appreciated that by carrying out rapid quenching in steps as described above, much less internal stress is imparted to the section as a whole thereby resulting in a concomitant reduction in cracking, plastic flow and deformation in the final product.

Figure 2:
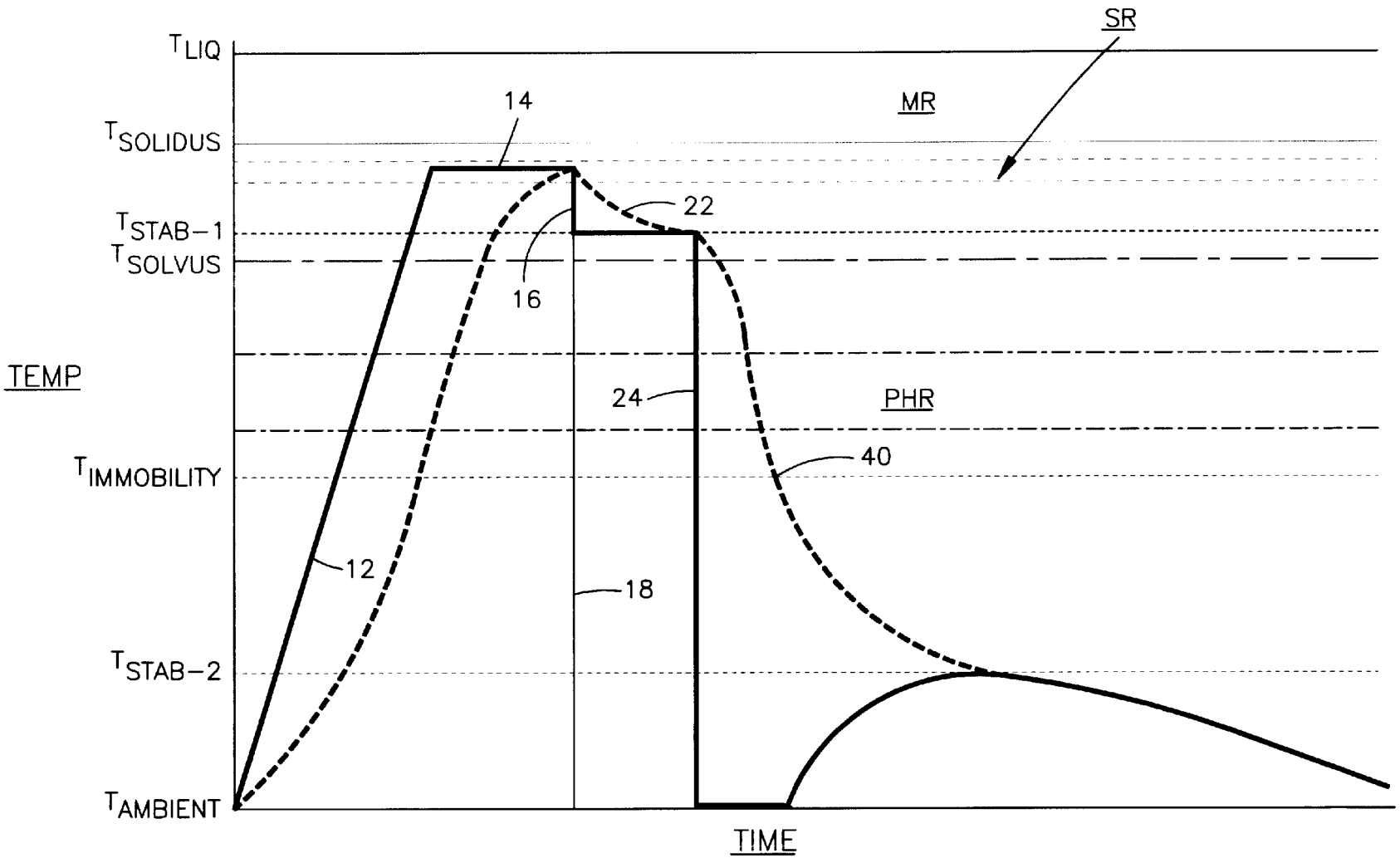
FIGS. 2 and 3 are schematic representations similar to FIG. 1 illustrating the surface and interior temperatures of large section, precipitation hardenable alloys being rapidly quenched in accordance with other quenching schemes of the present invention.

FIG. 2 illustrates another embodiment of the invention in which the section is rapidly quenched by immersion in water. In this embodiment, the section is stabilized at the first stabilization temperature in the same way as FIG. 1 and then immersed in a water quench bath where its is held until its internal temperature reaches the immobility temperature at point 40. At that time, the section is taken out of the water bath and allowed to sit in air at ambient temperature, a relatively slow cooling process conductive to stress minimization. As a result, the internal and external temperatures of the section merge at the second stabilization temperature, $T_{STAB\text{-}2}$, which is significantly below the immobility temperature, $T_{IMMOBILITY}$, and then reduce to ambient.

Figure 3:
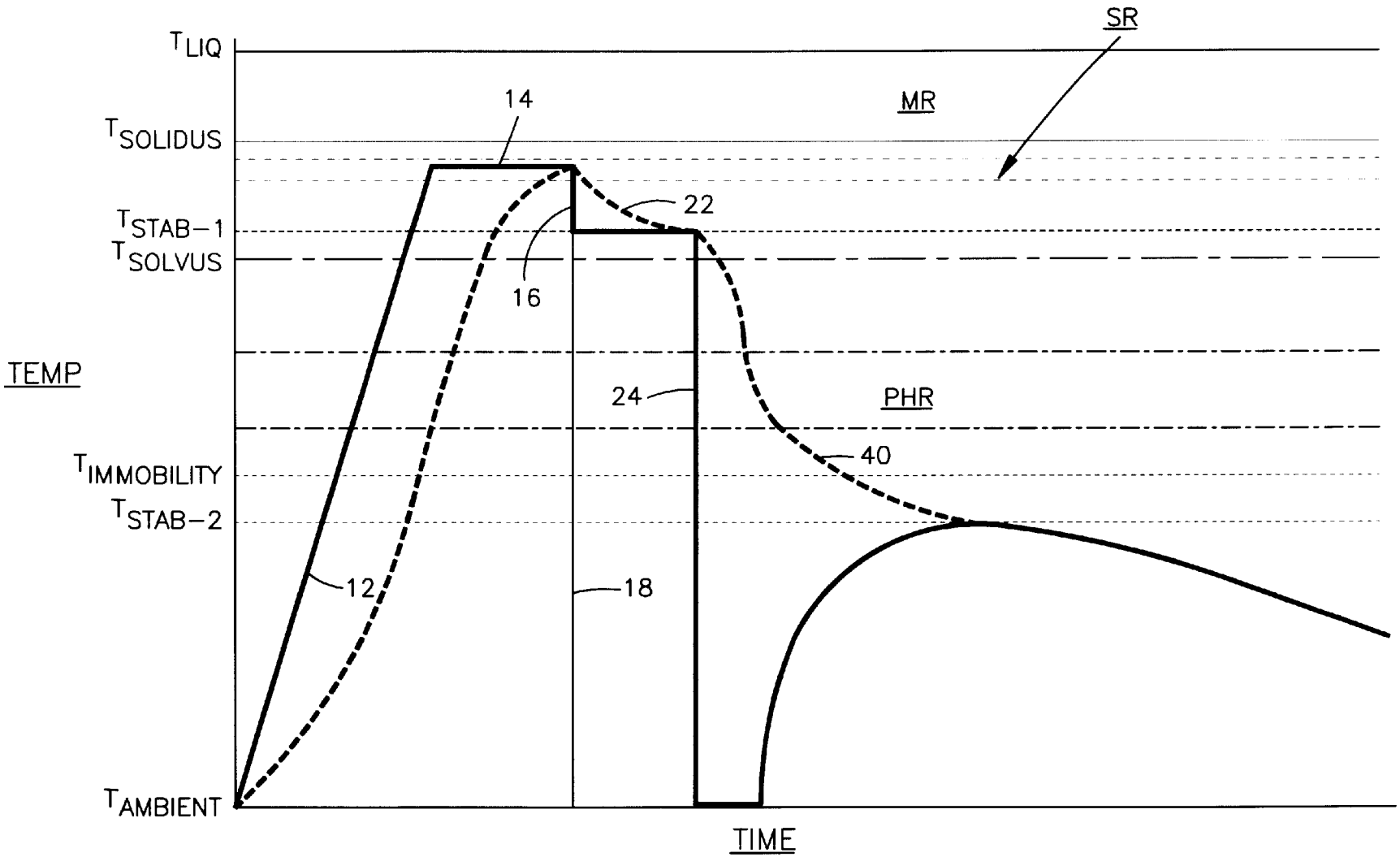

FIG. 3 illustrates still another embodiment of the invention in which the section is also rapidly quenched by immersion in water. In this instance, however, the section is withdrawn from its quench bath early enough so that the section's internal and external temperature merge at a second stabilization temperature, $T_{STAB-2}$, which is only slightly below the immobility temperature, $T_{IMMOBILITY}$. In this instance, cooling of the section's interior is slowed while it is still in precipitation hardening range, PHR. Although unwanted phases may occur in the section interior by operating in this way, this may be unimportant as a practical matter.

In any event, in both FIGS. 2 and 3 the section's surface temperature rises significantly from ambient towards the immobility temperature during the third step of the inventive cooling process. This reduces a significant part of the stress put on the section during the third part of the quenching operation, relative to conventional quenching. This stress reduction, coupled with the stress reduction achieved by the first temperature stabilization, effectively reduces cracking, plastic flow and deformation in the final product obtained.

Temperature Stabilization

In accordance with the invention, rapid quenching of a precipitation hardenable alloy is carried out so that the temperature of the alloy, as a whole, stabilizes or equilibrates at a first stabilization temperature near the alloy's solvus temperature and preferably again at a second stabilization temperature above the final quench temperature yet at or below the alloy's immobility temperature. In this context, "stabilizing" or "equilibrating" mean that the difference between internal and external temperatures of the section is reduced enough so that a noticeable reduction occurs in the amount of internal stress imparted to the alloy mass relative to quenching using water immersion as the cooling mechanism. Usually, this means that the difference between internal and external temperatures of the alloy section will reduce to about 100° F. (56° C.) or less, preferably about 50° F. (28° C.) or less, or even about 25° F. (14° C.) or less before stabilization is terminated and further cooling is initiated. It does not mean that the temperature of the section (whether internal, external or average) needs to become static for any finite period of time. Similarly, stabilizing "near" the solvus temperature in this context means a temperature within 100° F. (56° C.), more typically within 75° F. (42° C.), and even 50° F. (28° C.), or even 25° F. (14° C.) of the solvus temperature. Of course, the first stabilization temperature should be above the solvus temperature, but may also be below the solvus temperature if the unwanted phases that might form from this mode of operation can be tolerated. Furthermore, stabilization can continue until the internal and external temperatures become equal, although this may be commercially impractical in some applications.

Achieving temperature stabilization at the first stabilization temperature (slightly above solvus) in accordance with the present invention can most easily be done by lowering the temperature of the annealing/homogenization furnace to this temperature and then allowing the alloy section to remain at this temperature until the difference between the internal and the surface temperatures of the alloy section approach zero. Alternatively, the alloy section can be moved to and held in a holding furnace maintained at the first stabilization temperature, as described in connection with FIGS. 1 to 3. In either case, the internal temperature of the alloy section can be measured with a thermocouple or other temperature measuring device, preferably where the section is likely to have its highest temperature during cooling. A comparison of this measured internal temperature with the furnace temperature gives a good indication of the difference between the internal and surface temperatures of the alloy section.

Once stabilization at the first stabilization temperature is complete, the alloy section is then rapidly quenched to the final quench temperature or, in accordance with the preferred embodiment of the invention, to a second elevated stabilization temperature where no unwanted phase changes occur as a practical matter. Rapid quench can be accomplished in accordance with this aspect of the invention in accordance with known techniques. For example, immersion (or other contact) of the alloy section in water or other cooling medium such as a gas, molten salt or the like can be used. Regardless of which approach is adopted, however, rapid quenching should continue until the temperature of the section interior drops to or below the immobility temperature, as this will prevent unwanted phases from forming in this area. As illustrated in FIG. 3, however, rapid quenching can be terminated earlier if the unwanted phases that might occur in the section interior can be tolerated.

Allowing the temperature of the alloy to stabilize at the second stabilization temperature (at or below the immobility temperature) in accordance with the preferred practice of the present invention can be done in the same way as stabilization at the first stabilization temperature—i.e., by holding the alloy section in a furnace or other medium (e.g. molten salt bath) at the second stabilization temperature until the difference between the section's internal and surface temperatures approaches zero. As in the case of the first temperature stabilization, routine experimentation may be necessary to determine the extent to which this temperature difference is allowed to approach zero, before further cooling occurs, as well as the particular second stabilization temperature to use.

Precipitation Hardenable Alloys

The present invention is applicable to all precipitation hardenable alloys. Examples of primary metal systems which can be designed to exhibit precipitation hardenability include aluminum, nickel, iron, copper, silver, gold, magnesium and titanium-based alloys.

A particularly useful alloy in connection with the present invention is composed of at least about 90 wt. % of a base metal comprising copper or nickel plus up to about 10 wt. % beryllium, preferably up to about 5 wt. % Be, more preferably up to about 3 wt. % Be. The addition of as little as 0.05 wt. % Be to these base metals produces dramatic enhancements in a number of properties including strength, oxidation resistance, castability, workability, electrical conductivity and thermal conductivity making them ideally suited for making the some or all of the metallic components of the inventive drilling motor. Be additions on the order of at least 0.1 wt. %, more typically 0.2 wt. % are more typical, with Be additions of at least 0.4 wt. % and even at least 0.5 wt. % being especially useful.

These Cu—Be and Ni—Be alloys may contain additional elements such as Co, Si, Sn, W, Zn, Zr, Ti, Al, Nb, Mn, Mg and others usually in amounts not exceeding 2 wt. %, preferably not exceeding 1 wt. %, per element with the total of such additional elements typically not exceeding 2 wt. %, preferably 1 wt. %. In addition, each of these base metal alloys can contain the other base metal as an additional ingredient. For example, the Cu—Be alloy can contain Ni as an additional ingredient, again in an amount of 0.1 wt. % or more but not exceeding 30 wt. %, more typically 0.2 to 15 wt. %. Usually such alloys will have no more than 2 wt. %, and even more typically no more than 1 wt. % of this additional ingredient.

These alloys are described, generally, in Harkness et al., Beryllium-Copper and Other Beryllium-Containing Alloys, *Metals Handbook,* Vol. 2, 10th Edition, © 1993 ASM International, the disclosure of which is incorporated by reference herein.

A preferred class of this type of alloy is the C81000 series and the C82000 series of high copper alloys as designated by the Copper Development Association, Inc. of New York, N.Y. Another preferred class of these alloys are the lean, high conductivity, stress relaxation resistant BeNiCu alloys described in U.S. Pat. No. 6,001,196, the disclosure of which is also incorporated herein by reference. These later alloys contain 0.15 to 0.5 wt. % Be, 0.4 to 1.25 wt. % Ni and/or Co, 0 to 0.25 wt. % Sn and 0.06 to 1.0 wt. % Zr and/or Ti.

Another class of alloys that is especially useful in practicing the present invention is the Cu—Ni—Sn spinodal alloys. These alloys, which contain about 8 to 16 wt. % Ni and 5 to 8 wt. % Sn, with the balance being Cu and incidental impurities, spinodally decompose when age hardened to provide alloys which are both strong and ductile as well as exhibit good electrical conductivity, corrosion resistance in chloride environments and cavitation erosion resistance. In addition, they are machineable, grindable, plateable and exhibit good non-sparking and anti-galling characteristics. These alloys are described in U.S. application Ser. No. 08/552,582, filed Nov. 3, 1995 (corresponds to New Zealand Patent No. 309290), the disclosure of which is also incorporated by reference. Especially preferred alloys of this type include those whose nominal compositions are 15Ni—8Sn—Cu (15 wt. % Ni, 8 wt. % Sn, balance Cu) and 9Ni—6Sn—Cu, which are commonly known as Alloys UNS C72700, C72900 and C96900 under the Unified Numbering System of the Copper Development Association. In addition to Ni and Sn, these alloys may also contain additional elements for enhancing various properties in accordance with known technology as well as incidental impurities. Examples of additional elements are B, Zr, Nb and Fe.

Large Sections

As indicated above, the present invention is particularly applicable to making alloy sections large alloy sections—i.e., sections whose minimum regular thickness dimension is large enough so that internal cracking and/or distortion of the section occurs if the section is rapidly quenched from its solution annealing temperature to ambient in a conventional mariner by immersion in water. By "minimum regular thickness dimension" is meant the minimum dimension of the article, be it a thickness, diameter, wall thickness or the like, regularly exhibited by the article over a substantial portion of its mass. "Minimum regular thickness dimension" is thus distinguished from a thickness dimension which is exhibited by the article over only an insubstantial part of its body. For example, a rectangular block 10 inches thick having a few 3 inch indentations would have a regular minimum thickness dimension of 10 inches, not 7 inches, since the 7 inch thickness of the article at these indentations is not regularly exhibit by the article over a substantial portion of its body.

Internal cracking and/or distortion are observed in conventionally-quenched precipitation hardenable alloys in sections having minimum regular thickness dimensions of 3 to 8 inches, depending on the particular alloy involved. Thus, the present invention contemplates making crack and distortion free large sections of precipitation hardenable alloys with minimum regular thickness dimensions as little as 3 inches. However, the present invention also contemplates making large alloy sections with larger minimum regular thickness dimensions such as 8 inches or more, 10 inches or more, 15 inches or more, 20 inches or more and even 28 inches and more.

The present invention is also applicable to making both wrought and unwrought alloys. That is to say, the products produced by the present invention may be either wrought products, having been subjected to one or more hot or cold working steps, or unwrought products.

The present invention is particularly used in solution annealing the large, continuously cast Cu—Ni—Sn sections made by the technology of U.S. application Ser. No. 08/552,582 (New Zealand Patent No. 309,290), the disclosure of which is incorporated herein by reference. In this technology, molten alloy is introduced into the continuous casting die in such a manner that turbulence is created at the liquid/solid interface. Because of this "turbocasting" procedure, a finer, more nearly uniform grain structure is achieved in the casting operation than possible before. As a result, the sections so obtained can be directly precipitation hardened without wrought processing first, in contrast with pre-existing technology where wrought processing is necessary to achieve the necessary grain structure. Because wrought processing has been eliminated, precipitation hardenable sections can be made in bigger sizes and/or more complex shapes than possible before. Accordingly, when it is desirable to solution anneal a turbocast section of a precipitation hardenable alloy as described in that application, solution annealing using the inventive quenching process can be used to particular advantage, since exceptionally large castings essentially free of stresses attributable to conventional solution annealing procedures can be produced.

Fully Hardenable

The present invention is capable of producing large sections of precipitation hardenable alloys which are fully hardenable. By "fully hardenable" is meant that the hardness and 0.2% yield strength of the alloy after precipitation hardening are at least 90% of the hardness and 0.2% yield strength when an otherwise identical alloy made in a section 1 inch thick is precipitation hardened under the same conditions. In other words, a fully hardenable section is one whose alloy can be precipitation hardened to a strength and hardness at least 90% of that obtained when a reference alloy of identical composition and method of manufacture, but made in a section 1 inch thick, is precipitation hardened under the same conditions.

Preferably, the hardness and strength of the alloy obtained in accordance with the present invention is at least 95%, more preferably at least 98%, of that of the reference alloy. Hardness and strength values at least 100% of those of the reference alloy are also contemplated.

Although only a few embodiments of the present invention have been described above, it should be appreciated that many modifications can be made without departing from the spirit and scope of the invention. All such modifications are intended to be included within the scope of the present invention, which is to be limited only by the following claims:

We claim:

1. A process for quenching a precipitation hardenable alloy in which the alloy is cooled from a solution annealing temperature down to a final quench temperature, the process comprising allowing the temperature of the alloy to stabilize at a first stabilization temperature which is lower than the solution annealing temperature and immediately above the solvus temperature before the alloy is rapidly quenched.

2. The process of claim 1, wherein the temperature of the alloy is allowed to stabilize at a second stabilization temperature above the final quench temperature yet not so high that any significant phase change occurs in the alloy.

3. The process of claim 2, wherein rapid quench occurs by contacting the alloy with water.

4. The process of claim 3, wherein the alloy is subsequently precipitation hardened by maintaining the alloy at a precipitation hardening temperature, the second stabilization temperature being within 150° F. of the precipitation hardening temperature.

5. The process of claim 1, wherein the alloy is a BeCu alloy containing 0.1 to 5 wt. % Be or a Cu—Ni—Sn spinodal alloy containing about 8 to 16 wt. % Ni and 5 to 8 wt. % Sn, with the balance being Cu and incidental impurities.

6. The process of claim 1, wherein a large section of the alloy is quenched.

7. A process for quenching a precipitation hardenable alloy from a solution annealing temperature near the solidus temperature of the alloy comprising cooling the alloy in a first cooling increment from its solution annealing temperature to a first stabilization temperature near the solvus temperature of the alloy, allowing the temperature of the alloy to stabilize at the first stabilization temperature, and thereafter rapidly cooling the alloy through a second cooling increment to a lower temperature where no significant phase change of the alloy occurs.

8. The process of claim 7, further comprising allowing the temperature of the alloy to stabilize at a second stabilization temperature above ambient yet not so high that any significant phase change occurs in the alloy.

9. The process of claim 8, wherein the alloy is subsequently precipitation hardened by maintaining the alloy at a precipitation hardening temperature, the second stabilization temperature being within 150° F. of the precipitation hardening temperature.

10. The process of claim 9, further comprising further cooling the alloy through a third cooling increment.

11. The process of claim 10, wherein the alloy is cooled to ambient in the third cooling increment.

12. The process of claim 7, wherein the alloy is a BeCu alloy containing 0.1 to 5 wt. % Be or a Cu—Ni—Sn spinodal alloy containing about 8 to 16 wt. % Ni and 5 to 8 wt. % Sn, with the balance being Cu and incidental impurities.

13. The process of claim 7, wherein the alloy has a minimum thickness dimension of at least about 8 inches.

* * * * *

UNITED STATES PATENT AND TRADEMARK OFFICE

CERTIFICATE OF CORRECTION

PATENT NO. : 6,387,195 B1 
DATED : May 14, 2002
INVENTOR(S) : William J. Bishop, Noel M. Brady, Walter R. Cribb and Anatoly A. Offengenden It is certified that error appears in the above-identified patent and that said Letters Patent is hereby corrected as shown below:

Title page,
Item [54], please delete "Selection" and insert -- Section --.

Signed and Sealed this

Sixteenth Day of July, 2002

*Attest:*

JAMES E. ROGAN
*Director of the United States Patent and Trademark Office*

*Attesting Officer*